US006845523B2

(12) United States Patent
Copp

(10) Patent No.: US 6,845,523 B2
(45) Date of Patent: Jan. 25, 2005

(54) RESCUE VEST WITH ROLLERS

(76) Inventor: Roger M. Copp, 25454 Alpine Ct., Murrieta, CA (US) 92563

( * ) Notice: Subject to any disclaimer, the term of this patent is extended or adjusted under 35 U.S.C. 154(b) by 0 days.

(21) Appl. No.: 10/882,032

(22) Filed: Jun. 30, 2004

(65) Prior Publication Data

US 2004/0242094 A1 Dec. 2, 2004

Related U.S. Application Data

(63) Continuation of application No. 10/222,516, filed on Aug. 16, 2002, now abandoned.

(51) Int. Cl.[7] ..... A41D 13/00
(52) U.S. Cl. ..... 2/463
(58) Field of Search ..... 2/102, 455, 456, 2/69, 463, 467, 16, 22–24, 462, 464; 280/7.15, 11.19, 7.11, 87.021, 87.01, 87.03, 87.041; 182/3–5

(56) References Cited

U.S. PATENT DOCUMENTS 2,130,439 A * 9/1938 Wheeler ..... 359/519
2,484,494 A * 10/1949 Ferguson ..... 2/24
5,725,224 A * 3/1998 Kerr ..... 280/11.19
5,794,275 A * 8/1998 Donzis ..... 2/455
5,870,774 A * 2/1999 Legenstein ..... 2/24
5,926,857 A * 7/1999 Blondeau ..... 2/456
6,510,560 B1 * 1/2003 Ugolnik ..... 2/455

* cited by examiner

*Primary Examiner*—Tejash Patel
(74) *Attorney, Agent, or Firm*—Donald W. Meeker

(57) ABSTRACT

A rescue vest has a spaced apart pair of vertical roller frames attached to the front, each frame having an inline array of wheels or alternate roller track on roller track wheels. Each adjacent pair of wheels or roller tracks having a narrow space therebetween has an axle attached to the frame between the narrow space and an external surface on which the user is rolling to prevent debris from entering therebetween. A lower front vest extension has an additional pair of tracks below the waist each with wheels or a roller track aligned with the tracks above the waist. Side spaces between a front and back vest portions or pair of back straps accommodate equipment carried on the hip of the wearer. Shoulder spaces and a front opening allow attachment of safety lines to a harness worn under the vest.

18 Claims, 3 Drawing Sheets

RESCUE VEST WITH ROLLERS

REFERENCES TO RELATED PATENTS

This is a continuation-in-part of utility patent application Ser. No. 10/222,516, filed Aug. 16, 2002 now abandoned.

BACKGROUND OF THE INVENTION

1. Field of the Invention

The present invention relates to safety and rescue equipment and in particular to a safety and rescue vest having a pair of rolling tracks built into a front of the vest to facilitate ease of movement through confined spaces which normally require a crawling movement.

2. Description of the Prior Art

Performing rescue operations or work duties, such as welding or repairs, or having to utilize a confined access to another space requiring a person to move through a very confined space, such as a concrete pipe which might be only 18 or 24 inches in diameter, normally requires a crawling movement with very limited propulsion through the space by moving fingers and toes or hands and feet depending on the degree of confinement.

Moving through a corrugated pipe or a pipe filled with debris further exacerbates the problem by creating more friction and obstacles to movement.

Very little attention has been paid to this problem which may be faced by fire rescue workers or pipe workers on a regular basis. Most safety and rescue clothing provides protection for the body but does not facilitate movement.

U.S. Pat. No. 5,289,959, issued Mar. 1, 1994 to Beeley, et al., illustrates an invention related to emergency transportation of more than one infant at a time by one rescue person. A plurality of pockets are located on the front and back of the rescue vest garment. The pockets each contain a seat over which the infant straddles and a ventilation structure through which the infant breathes toward the rescue person. A pocket flap further shields the transported infant.

U.S. Pat. No. 6,256,789, issued Jul. 10, 2001 to Young, et al., puts forth a combination clothing/safety harness for fall arresting and rescue from confined spaces provides the advantages of ease of use, distribution of forces over a wide surface area, protection of the harness portion, and ease of enforcing regulations that the harness be worn. The safety harness may be attached to various articles of clothing, such as a jacket, vest, overalls, or coveralls, so that donning the article of clothing automatically positions the harness for use. The harness may be used by employees working at dangerous heights or in confined spaces, or by hunters using tree stands. Combination clothing/safety harness systems can be made to meet OSHA requirements.

U.S. Pat. No. 4,593,788, issued Jun. 10, 1986 to Larry Miller, concerns a rescue vest provided with a pocket extending along the spine area in the back of the vest. A thin, flat, elongated stiffener is removably positioned in the pocket and a head support and protector is removably positioned on the upper end of the stiffener. The vest can be positioned on and strapped to a person's torso, with the stiffener being used to immobilize the person's spine and neck. The vest may be positioned on the person without the stiffener and the stiffener then inserted into the vest. Groin straps attached to the lower portion of the vest enable a person to be lifted by means of the vest. Thus, without the stiffener, the vest may be used for lifting or lowering a rescuer.

U.S. Pat. No. 5,970,517, issued Oct. 26, 1999 to Omar P. Jordan, discloses a harness assembly having an integral support line. The harness assembly includes a harness body having first and second ends and a hollow interior which receives the support line. The support line has first and second ends that extend from the harness body. The harness is secured within a garment. The garment has a front opening which is normally covered by a releasable flap. The first and second ends of the support line extend through the front opening and are accessible when the flap is moved to an open position. The first end of the support line may be pulled away from the harness to extend the support line therefrom. The second end of the support line is secured to the harness.

U.S. Pat. No. 6,062,342, issued May 16, 2000 to Dale Dobson, describes a rescue device for assisting in removing an individual from a confined space comprises a sheet having a first end with one or more through apertures and a sheet section extending from the first end having one or more through apertures and a securing device for securing the sheet section and the first end together. The sheet section is adapted to curl around so as to selectively bring a through aperture of the sheet section adjacent to a through aperture of the first end thereby to form an enclosure of a selective dimension. The securing device secures the sheet section and the first end together when the through aperture of the sheet section is in corresponding arrangement with the through aperture of the first end.

What is needed is a rugged safety vest with built-in wheel tracks in front and openings for attaching a safety line to a harness under the vest to assist people in moving through confined spaces normally requiring a crawling motion.

SUMMARY OF THE INVENTION

An object of the present invention is to provide a rescue and safety vest with built-in wheels to facilitate the movement of a person through a very confined space normally traversed by crawling.

Another object of the present invention is to provide a rescue and safety vest with a built-in wheel track to facilitate the movement of a person through a very confined space having corrugations, debris, or other non-smooth surface or obstacles preventing a rolling motion with wheels.

One more object of the present invention is to provide a rescue and safety vest with rolling means for confined spaces which vest also provides openings to facilitate equipment normally carried by the rescue worker and to facilitate attaching safety lines to a harness worn under the vest.

An additional object of the present invention is to provide a wheeled rescue and safety vest with at least two separate tracks of wheels or roller tracks to permit bending.

One more object of the present invention is to provide a rescue and safety vest with adjustable straps around the sides and over the shoulders to permit wearing of the vest by people of various sizes and body types.

In brief, a rescue and safety vest comprises a front panel fitted with two vertical rows of low profile inline wheels, which could be inline skate wheels, spaced apart by about 7 inches or other appropriate distance for different body sizes and types to permit rolling on the wheels by a person wearing the vest inside a confined space such as a concrete pipe.

The wheels are on rigid frames attached to the vest by rivets or other attaching means through holes in the frames and through the rugged material of the vest, which could be canvas or leather or other rugged material. Two spaced rows of inline wheels each row having several inline wheels, preferably three, are mounted on a frame approximately 10 inches long on a top front portion of the vest corresponding to the upper torso. A separate pair of frames is attached to the bottom front of the vest over a upper legs or thighs of the wearer, which may be a single wheel on each frame on each side with each frame in line with one of the upper rows of wheels and spaced apart from the upper frames, so that the wearer gets maximum rolling capability on the torso and upper legs or thighs while being free to bend in a normal fashion due to the separation between the upper and lower frames which separation is located in line with the waist of the wearer.

The wheels may be removable from the frame and replaceable by a rolling track, similar to a tank track but with a rubber track, for movement through corrugated pipes, or spaces with debris or other rough surfaces which would not allow wheels to roll.

A front vest portion is separate from a back vest portion with space between the front and back at both the top over the shoulders to accommodate access to harness straps over the shoulders and down the sides to accommodate a hip air pack and other apparatus carried by rescue workers. Adjustable straps over the shoulders and on the sides adjustably interconnect the front and back to fit people of different sizes and shapes.

An opening in the front center of the vest between wheel rows allows safety straps to attach to a body harness worn by the rescue worker.

An advantage of the present invention is that people can move more easily through confined spaces by rolling rather than crawling.

Another advantage of the present invention is that it provides easier movement through confined spaces while still allowing normal functioning and normal access to equipment.

An additional advantage of the present invention is that it is adaptable to work in confined spaces having smooth surfaces or irregular surfaces or debris.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
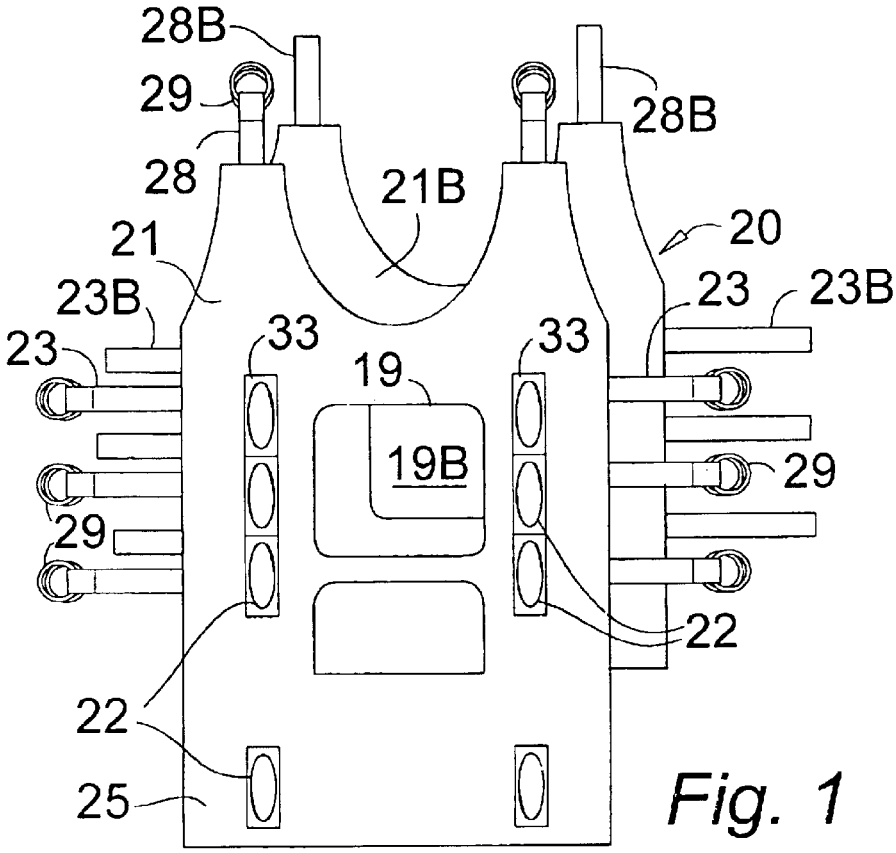
FIG. 1 is a front elevational view of the rescue vest with rollers showing the adjustable straps aligned for connecting.

In FIG. 1, a rolling rescue garment device 20 assists a wearer, such as a rescue worker, in moving through confined spaces, such as concrete pipes.

A front garment portion or front vest portion 21 fits over the front torso of the wearer, and has a low profile rolling means, namely inline wheels 22, attached to and protruding forward therefrom a sufficient amount to facilitate a rolling movement of the wearer along an external surface on the rolling means with the torso of the wearer spaced apart from the surface.

An adjustable means of attaching the front garment portion or front vest portion 21 to the body of the wearer comprises a back vest portion 21B and shoulder straps 28 and 28B over each shoulder and side straps 23 and 23B at each side interconnecting the front vest portion and the back vest portion with an adjustable connecting means, such as rings 29.

The front vest portion 21 and the back vest portion 21B are spaced apart on the sides to accommodate equipment carried on the hips of the wearer and spaced apart on the shoulders to accommodate safety lines attachable to the body harness at the shoulders. A front opening area 19, which could be a double open channel similar in shape to the double opening in the upper frame 26A, between the wheel tracks 33 and back opening area 19B accommodate safety lines attachable to the body harness in the front or back.

Figure 2:
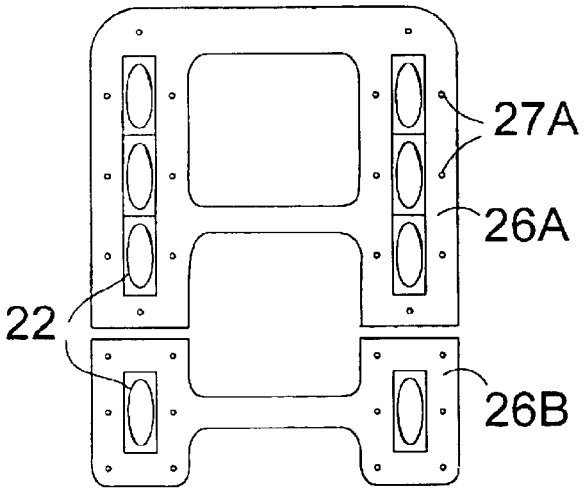
FIG. 2 is a front elevational view of the upper and lower tracks supporting the wheels.
Figure 3:
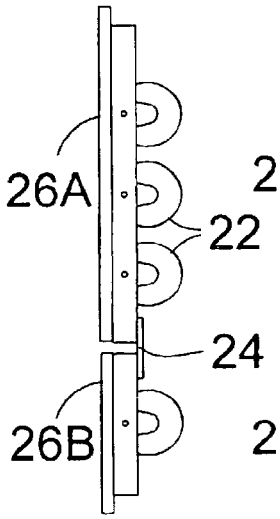
FIG. 3 is a side elevational view of the wheel frames with wheels mounted thereon.

In FIGS. 2 and 3 the low profile rolling means comprises a parallel spaced pair of wheel tracks 33 in the roller frame 26A, which may be interconnected by cross members, attached to the front garment portion 21 by rivets 27 or other connecting means through frame rivet holes 27A. Each of the pair of tracks has a vertical inline rolling means, such as a set of inline wheels 22 which may be a set of inline skate wheels each rotatably attached by axle means to the tracks.

Figure 4:
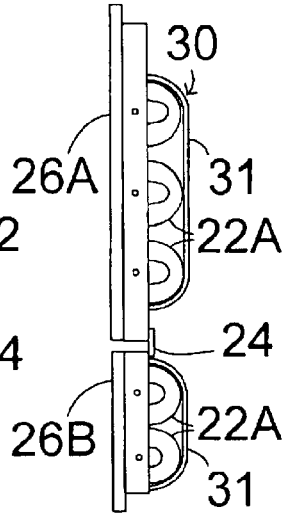
FIG. 4 is a side elevational view of the frames with roller tracks mounted thereon.

In FIG. 4 the inline rolling means comprises a wheel track 33 having an outer roller track 31 around roller track wheels 22A rotatably attached to the frame to permit rolling inside corrugated pipes or over debris or other situations preventing the use of wheels.

In FIG. 1 a lower garment extension 25 of the front garment portion or front vest 21 extends below a waist of the wearer and a second set of tracks 33 in a roller frame 26B each having a rolling means, such as wheels 22, is attached to the lower garment extension 26B in line with and spaced apart from the upper tracks 26A to facilitate rolling support of the upper legs or thighs of the wearer while still allowing bending at the waist.

In FIGS. 5–8, a preferred embodiment of a rolling rescue garment device 20A to assist a wearer in moving through confined spaces comprises a front vest 21 with spaced parallel rolling tracks 33 in a roller frame 26A and 26B riveted to the front vest 21.

A front garment portion adapted to cover a front torso and upper legs of a wearer comprises an elongated front vest 21 fabricated of wear resistant material, preferably Cordura® with wear resistant edging 18 applied. A spaced parallel pair of vertical wheel tracks 33 or channels are attached to the front vest in low profile roller frames 26A and 26B, preferably fabricated of polycarbonate secured to the vest 21 preferably by rivets 27.

Figure 5:
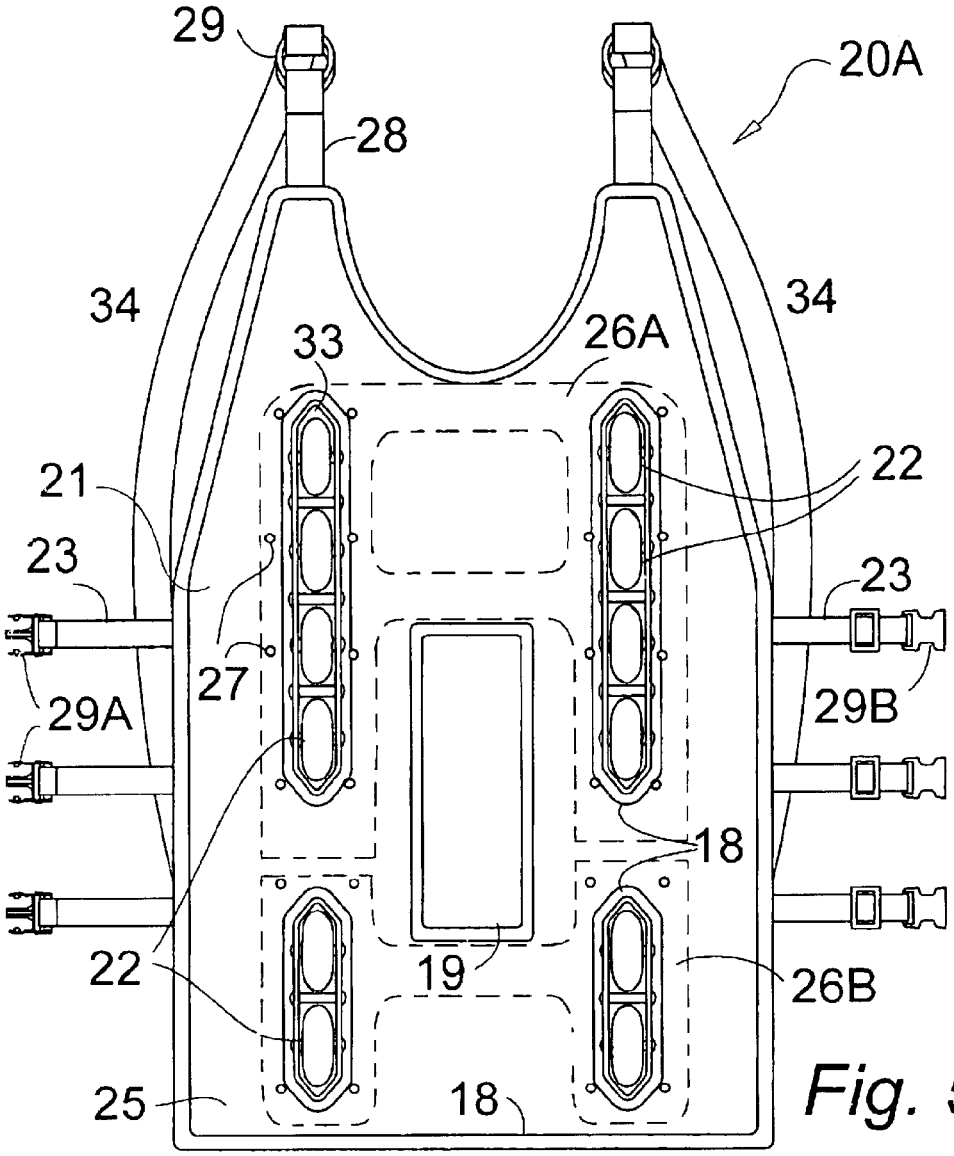
FIG. 5 is a front elevational view of the preferred embodiment of the rescue vest of the present invention having paired parallel spaced wheel tracks of inline wheels.
Figure 6:
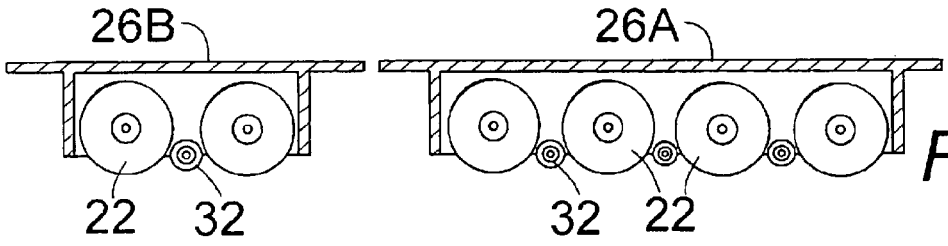
FIG. 6 is a side elevational view of the inline wheels in the wheel tracks of the preferred embodiment of FIG. 5.
Figure 7:
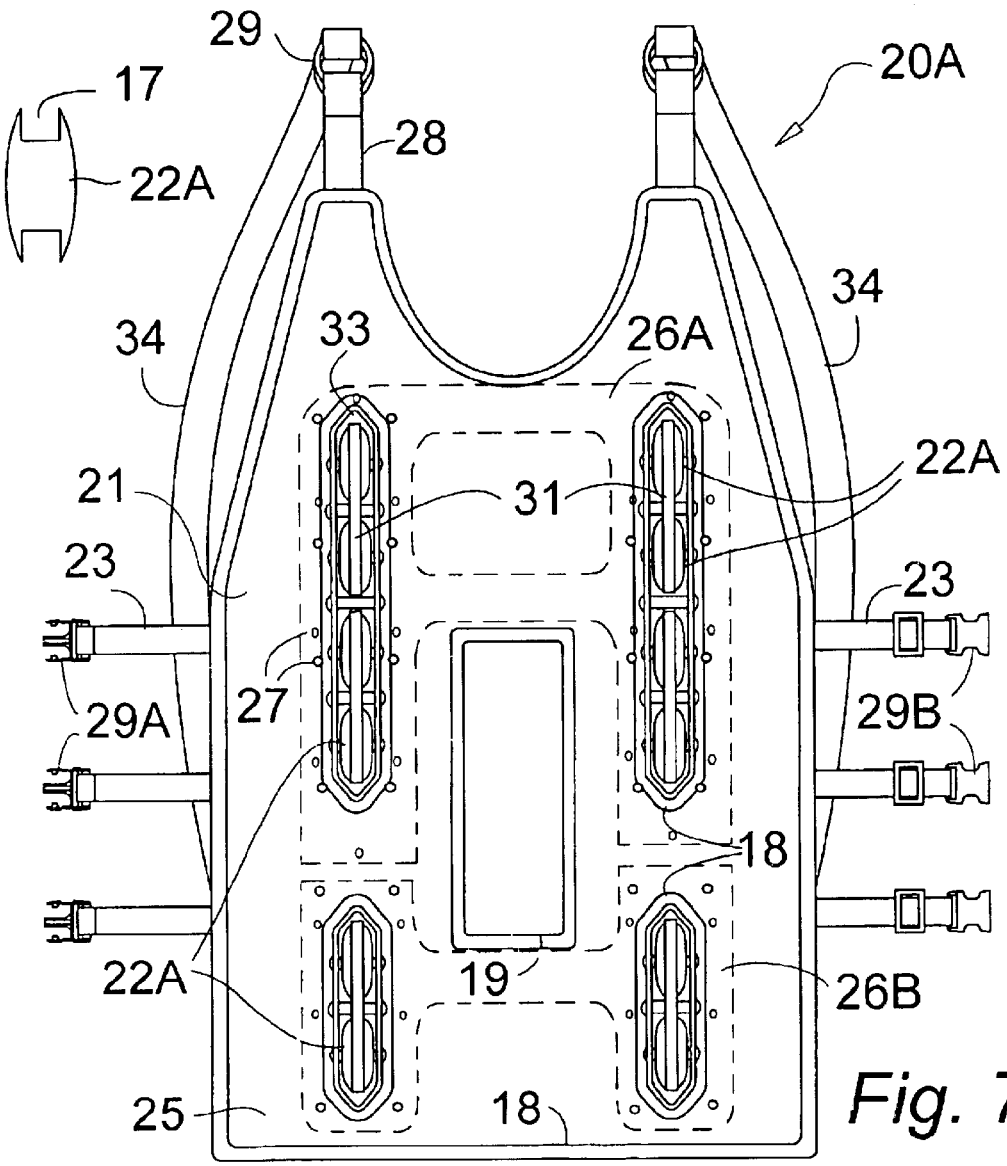
FIG. 7 is a front elevational view of the preferred embodiment of the rescue vest of the present invention having paired parallel spaced wheel tracks of roller tracks.
Figure 8:
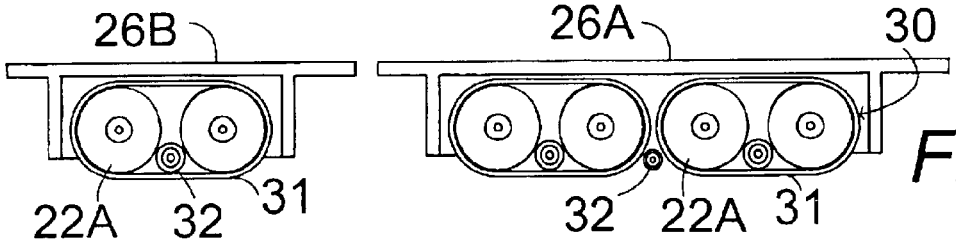
FIG. 8 is a side elevational view of the roller tracks in the wheel tracks of the preferred embodiment of FIG. 7.

Each of the wheel tracks 33 has a series of wheeled rollers, such as inline wheels 22, in FIGS. 5 and 6, or roller track rollers 22A with peripheral annular recesses 17 to receive roller tracks 31 therein, in FIGS. 7 and 8, attached thereto and protruding forward from the front vest and the roller frame a sufficient distance to facilitate a rolling movement of the wearer along an external surface, such as the inside of a concrete pipe or other confining space, on the wheeled rollers with the torso of the wearer spaced apart from the external surface.

A back portion, such as a back vest similar to the front vest 21 without attached rolling means or back straps 34, in FIGS. 5 and 7, is attachable to the front garment portion by an adjustable means, such as adjustable shoulder straps 28 with rings 29 or side straps 23 with inline adjustable means attachable by snap clips 29A and 29B together to secure the device to a body of a wearer. The front vest and the back vest are spaced apart on the sides to accommodate equipment carried on the hips of the wearer and spaced apart at the shoulders a sufficient distance to accommodate a safety line attachable therebetween to a safety harness with shoulder straps worn on a torso of a wearer.

In FIGS. 5 and 7, a central opening 19 through the front vest 21 accommodates a safety line attachable to a safety harness worn on a front torso of a wearer.

In FIGS. 5 and 6, the wheeled rollers in each of the frames comprise a series of inline wheels 22 each rotatably attached to the frame 26A and 26B spaced closely to an adjacent one of the inline wheels with a narrow space therebetween sufficient to allow rotation of each of the wheels without contacting adjacent wheels. The means for preventing debris from entering between adjacent wheeled rollers comprises a rotatable axle 32 attached to the frame in alignment with the space between the bottom halves of each pair of adjacent wheels, the axle fitting within a space between the bottom halves of each of the adjacent wheels and an external surface to prevent debris between wheels.

In FIGS. 7 and 8, the wheeled rollers in each of the frames comprises a series of inline grouped roller track wheels 22A each having an annular peripheral groove 17 to receive a roller track 31, each rotatably attached to the frame 26A and 26B spaced closely to an adjacent one of the inline roller track wheels, each group of roller track wheels supporting a roller track 31 encircling the group of roller track wheels for contacting an external surface and the means for preventing debris from entering between adjacent roller track wheels comprises the roller track 31 and the means for preventing debris from entering between adjacent groups of roller track wheels with a roller track comprises a rotatable axle 32 attached to the frame between each adjacent pair of groups of roller track wheels with a track aligned with the space therebetween and fitting in the space between the bottom halves of the groups of roller track wheels and the external surface. Preferably each group of roller track wheels comprises two roller track wheels 22A to insure the roller track 31 stays on the roller track wheels 22A.

The device of claim 1 further comprising a lower garment extension 25 of the front garment portion extending below a waist of the wearer and a second set of roller frames 26B each having a series of wheeled rollers, either inline wheels 22 as in FIGS. 5 and 6 or inline roller track wheels 22A and roller tracks 31 as in FIGS. 7 and 8, therein attached to and protruding forward from the front vest and the roller frame a sufficient amount to facilitate a rolling movement of the wearer along an external surface on the wheeled rollers attached to the lower garment extension in line with and spaced apart from the upper roller frames to facilitate rolling support of the abdomen of the wearer while still allowing bending at the waist.

It is understood that the preceding description is given merely by way of illustration and not in limitation of the invention and that various modifications may be made thereto without departing from the spirit of the invention as claimed.

What is claimed is:

1. A rolling rescue garment device to assist a wearer in moving through confined spaces, the device comprising:

a front garment portion adapted to cover a front torso and upper legs of a wearer, the front garment portion comprising an elongated front vest fabricated of wear resistant material and a spaced pair of low profile roller frames secured to the vest, each of the roller frames having a series of wheeled rollers therein attached to and protruding forward from the front vest and the roller frame a sufficient distance to facilitate a rolling movement of the wearer along an external surface on the wheeled rollers with the torso of the wearer spaced apart from an external surface, the low profile roller frames comprising a parallel spaced pair of vertical frames attached to the front vest, and further comprising a means for preventing debris from entering between adjacent wheeled rollers in each of the roller frames;

a back portion attachable to the front garment portion by an adjustable means to secure the device to a body of a wearer;

wherein the front vest is provided with a central opening therethrough to accommodate a safety line attachable to a safety harness worn on a front torso of a wearer.

2. The device of claim 1 wherein the wheeled rollers in each of the frames comprises a series of inline wheels each rotatably attached to the frame spaced closely to an adjacent one of the inline wheels with a narrow space therebetween sufficient to allow rotation of each of the wheels without contacting adjacent wheels, and the means for preventing debris from entering between adjacent wheeled rollers comprises a rotatable axle attached to the frame in alignment with the space between each pair of adjacent wheels, the axle fitting within a space between each bottom halves of the adjacent wheels.

3. The device of claim 1 wherein the wheeled rollers in each of the frames comprises a series of inline grouped roller track wheels, each rotatably attached to the frame spaced closely to an adjacent one of the inline roller track wheels, each group of roller track wheels supporting a roller track encircling the group of roller track wheels for contacting an external surface and the means for preventing debris from entering between adjacent roller track wheels comprises the roller track and the means for preventing debris from entering between adjacent groups of roller track wheels with a roller track comprises a rotatable axle attached to the frame between bottom halves of each adjacent pair of groups of roller track wheels with a track.

4. The device of claim 3 wherein each group of roller track wheels comprises two roller track wheels.

5. The device of claim 1 further comprising a lower garment extension of the front garment portion extending below a waist of the wearer and a second set of roller frames each having a series of wheeled rollers therein attached to and protruding forward from the front vest and the roller frame a sufficient amount to facilitate a rolling movement of the wearer along an external surface on the wheeled rollers attached to the lower garment extension in line with and spaced apart from the upper roller frames to facilitate rolling support of the abdomen of the wearer while still allowing bending at the waist.

6. The device of claim 1 wherein each of the roller frames is formed of polycarbonate.

7. The device of claim 1 wherein each of the roller frames is attached to the front vest by a series of rivets.

8. The device of claim 1 wherein the back portion comprises a back vest attached to the front vest by at least one strap over each should and at least one strap at each side interconnecting the front vest portion and the back vest portion, each of the straps having a means of adjusting the length of the strap.

9. The device of claim 8 wherein the front vest and the back vest are spaced apart on the sides to accommodate equipment carried on the hips of the wearer.

10. The device of claim 1 wherein the back portion comprises two back straps attached from the shoulder to the bottom section of the vest, and at least one strap at each side interconnect by snap clips, each of the straps having a means of adjusting the length of the strap.

11. The device of claim 1 wherein the wear resistant material of the front vest comprises Cordura®.

12. The device of claim 1 wherein the front vest and the back portion are spaced apart a sufficient distance to accommodate a safety line attachable therebetween to a safety harness worn on a torso of a wearer.

13. A rolling rescue garment device to assist a wearer in moving through confined spaces, the device comprising:

a front garment portion over the front torso of the wearer, the front garment portion having a low profile rolling means attached to and protruding forward therefrom a sufficient amount to facilitate a rolling movement of the wearer along an external surface on the rolling means with the torso of the wearer spaced apart from the surface, the low profile rolling means comprising a spaced pair of tracks attached to the front garment portion, each of the pair of tracks having a vertical inline rolling means;

an adjustable means of attaching the front garment portion to the body of the wearer;

wherein the front garment comprises a front vest portion and the adjustable attaching means comprises a back vest portion and at least one strap over each should and at least one strap at each side interconnecting the front vest portion and the back vest portion with an adjustable connecting means;

wherein the wearer is wearing a safety harness under the rescue vest and the front vest portion is provided with a central opening therethrough to accommodate a safety line attachable to the harness on the front torso.

14. The device of claim 13 wherein the inline rolling means comprises a series of inline wheels each rotatably attached to the frame.

15. The device of claim 13 wherein the inline rolling means comprises a roller track rotatably attached to the frame.

16. The device of claim 13 further comprising a lower garment extension of the front garment portion extending below a waist of the wearer and a second set of tracks each having a rolling means attached to the lower garment extension in line with and spaced apart from the upper tracks to facilitate rolling support of the abdomen of the wearer while still allowing bending at the waist.

17. The device of claim 13 wherein the front vest portion and the back vest portion are spaced apart on the sides to accommodate equipment carried on the hips of the wearer.

18. The device of claim 13 wherein the wearer is wearing a safety harness under the rescue vest and the front vest portion and the back vest portion are spaced apart on the shoulders to accommodate safety lines attachable to the harness at the shoulders.

* * * * *